US006070525A

United States Patent [19]

Watanabe et al.

[11] Patent Number: 6,070,525

[45] Date of Patent: Jun. 6, 2000

[54] PRINTING APPARATUS AND RECORDING METHOD FOR USE IN SUCH APPARATUS

[75] Inventors: Hideo Watanabe; Noboru Inamina, both of Ibaraki-ken, Japan

[73] Assignee: Riso Kagaku Corporation, Tokyo, Japan

[21] Appl. No.: 09/039,321

[22] Filed: Mar. 16, 1998

[30] Foreign Application Priority Data

Mar. 28, 1997 [JP] Japan ..... 9-077356

[51] Int. Cl.[7] ..... B41N 1/24

[52] U.S. Cl. ..... 101/129; 101/120; 101/128.21

[58] Field of Search ..... 101/128.21, 129, 101/119, 120

[56] References Cited

U.S. PATENT DOCUMENTS

| | | | |
|---|---|---|---|
| 5,662,039 | 9/1997 | Watanabe et al. | 101/129 |
| 5,857,410 | 1/1999 | Watanabe et al. | 101/128.21 |
| 5,924,360 | 7/1999 | Adachi et al. | 101/128.21 |

FOREIGN PATENT DOCUMENTS

| | | |
|---|---|---|
| 0635362 | 1/1995 | European Pat. Off. . |
| 0771647 | 3/1997 | European Pat. Off. . |
| 0767053 | 4/1997 | European Pat. Off. . |
| 0812680 | 12/1997 | European Pat. Off. . |
| 2206704 | 7/1994 | France . |
| 4979240 | 7/1974 | Japan . |

*Primary Examiner*—Eugene Eickholt
*Attorney, Agent, or Firm*—Kanesaka & Takeuchi

[57] ABSTRACT

A printing apparatus is formed of a printing drum which is rotationally driven around a central axis of itself with a heatsensitive stencil sheet around an outer circumferential surface of itself, liquid ejecting device for forming an image from photothermal conversion material on the stencil sheet by ejecting a liquid containing the photothermal conversion material to the stencil sheet and for forming an image on a printing paper by ejecting a liquid containing a colorant and the photothermal conversion material, light radiating device for perforating the stencil sheet by radiating light to the stencil sheet with the photothermal conversion material on it, a pressing device for pressing the printing paper against the printing drum, the printing paper being supplied in synchronization with rotation of the printing drum, and for transferring an ink supplied to an inner spherical surface of the printing drum to the printing paper through the perforated stencil sheet, and control device for controlling diameters $R_1$,$R_2$ and distances $D_1$,$D_2$ so that the formula $D_1>R_1$, $R_2 \geqq D_2$ is satisfied, where the diameter $R_1$ is a diameter of a dot of the liquid transferred to the stencil sheet, the diameter $R_2$ is a diameter of a dot of the liquid transferred to the printing paper, the distance $D_1$ is a center distance between the two dots adjacent to each other on the stencil sheet, and the distance $D_2$ is a center distance between the two dots adjacent to each other on the printing paper.

12 Claims, 7 Drawing Sheets

PRINTING APPARATUS AND RECORDING METHOD FOR USE IN SUCH APPARATUS

BACKGROUND OF THE INVENTION

The present invention concerns a printing apparatus capable of performing effective printing by two types of printing methods for printing from a small number of sheets to a large number of sheets. Especially, the present invention relates to the printing apparatus being capable of obtaining printed matters of clearness and intense density, and a recording method for use in such apparatus.

In the field of a digital printing apparatus of high speed printing at a low running cost, stencil printing has been popularized. In such stencil printing, a thermoplastic resin film of a stencil sheet is melted and perforated by a heating means such as a thermal head which generates heat in dot-like form as character and picture information according to an electrical signal.

In using the digital printing apparatus, owing to irregularity of contact-pressure between the thermal head and a platen roller, there may occur perforation failure, creasing in the stencil sheet and conveyance failure of the stencil sheet.

Further, although an existent digital printing apparatus is useful in the case of printing a large number of identical printed matter, if the number of sheets for printing is small, the printing cost is rather increased since the stencil sheet is used. With regard to the background thus stated, if the digital printing apparatus includes heatsensitive recording paper or heatsensitive transfer recording paper for a small number of sheet printing, it may be considered possible that one printing method is optionally selected from among the stencil printing and printing by the heatsensitive recording paper according to the number of printing sheets. However, such constitution enlarges the digital printing apparatus and further requires at least two types of recording paper, ie normal printing paper and the heatsensitive recording paper, which causes a drawback of complicating the operation of the apparatus.

Further, a composite type printing apparatus has also been proposed which combines different printing methods of using common printing paper. The composite type printing apparatus conducts electrophotographic printing in the case where a number of printing sheets is small, and also conducts printing by using heat sensitive stencil sheet in the case where a number of printing sheets is large. But it has a drawback that the entire system is complicated, expensive and enlarged in the size.

On the other hand, in order to obtain colored printed matters by the digital printing apparatus, an ink-charged drum has to be prepared for each of colors. Such apparatus requires, even in a partial color printing, a troublesome operation of exchanging the drum at every time when previous printing in different color is finished. This operation worsens the efficiency.

Further, the applicant examined perforation condition in a stencil sheet processed by the digital printing apparatus. As a result, it is discovered that an excessive amount of ink passed through an area of a heatsensitive stencil sheet where dot-shape holes were perforated in a successive manner by the thermal heat. This deteriorated printing quality by causing bleeding of an image like a character formed on printing paper. Further, set-off and seeping-through in printed matters were apt to occur.

Further, it is also discovered that an adequate amount of ink had properly passed through an area in a stencil sheet where dot-shape holes perforated by the thermal head were independent and not connected with each other. Consequently, an image like a character formed on printing paper was clear, set-off and seeping-through were not found in printed matters, thereby obtaining printed matters of high quality.

An object of the present invention is to provide a recording apparatus and a recording method capable of performing an effective printing from a small number of sheet to a large number of sheet at a low running cost by selectively using plural types of printing method, thereby obtaining printed matters of high quality with clearness and intense density.

SUMMARY OF THE INVENTION

The printing apparatus as defined in the first aspect of the present invention, comprises an ink-permeable printing drum in a cylindrical shape which is rotatably driven around a central axis of itself with a heatsensitive stencil sheet wrapped around an outer circumferential surface of itself, a liquid ejecting means for forming an image from photothermal conversion material on the heatsensitive stencil sheet by ejecting a liquid containing the photothermal conversion material to the heatsensitive stencil sheet and for forming an image on a printing paper by ejecting a liquid containing a material selected from the group including a colorant and the photothermal conversion material, a light radiating means for perforating the heatsensitive stencil sheet by radiating light to the heatsensitive stencil sheet with the photothermal conversion material transferred thereon, a pressing mechanism for pressing the printing paper which is supplied in synchronization with rotation of the printing drum against the printing drum and for transferring an ink supplied to an inner spherical surface of the printing drum to the printing paper through the perforated heatsensitive stencil sheet, and a control means for controlling diameters $R_1$,$R_2$ and distances $D_1$,$D_2$ so that the formula $D_1>R_1,R_2\geqq D_2$ is satisfied, where the diameter $R_1$ is a diameter of a dot of the liquid transferred to the heatsensitive stencil sheet, the diameter $R_2$ is a diameter of a dot of the liquid transferred to the printing paper, the distance $D_1$ is a center distance between two dots adjacent to each other on the heatsensitive stencil sheet, and the distance $D_2$ is a center distance between two dots adjacent to each other on the printing paper.

In the printing apparatus defined in the second aspect of the present invention, the control means controls the diameters $R_1$,$R_2$ so that the formula $R_2\geqq R_1$ is satisfied in the printing apparatus as defined in the first aspect.

The printing apparatus defined in the third aspect of the present invention comprises an original image input means and a reverse image generating means for reversing original image data input through the original image input means into reverse image data, whereby a reverse image is recorded on the heatsensitive stencil sheet according to the reverse image data in the first aspect.

In the printing apparatus defined in the fourth aspect of the present invention, the liquid ejecting means includes a sole ejecting head disposed selectively at either of a position for ejecting the liquid to the heatsensitive stencil sheet or a position for ejecting the liquid to the printing paper, thereby ejecting the liquid selectively to the heatsensitive stencil sheet or the printing paper in the first aspect.

In the printing apparatus defined in the fifth aspect of the present invention, the liquid ejecting means includes plurality of ejecting heads for respectively ejecting plurality of the liquid containing the colorants in different tones so that multicolor printing can be performed in the first aspect.

In the printing apparatus as defined in the sixth aspect of the present invention, the heatsensitive stencil sheet includes thermoplastic resin film and liquid absorbent layer laminated on the thermoplastic resin film for absorbing the liquid ejected from the liquid ejecting means in the first aspect.

The recording method defined in the seventh aspect of the present invention for use in a printing apparatus which comprises an ink-permeable printing drum in a cylindrical shape which is rotatably driven around a central axis of itself with a heatsensitive stencil sheet wrapped around an outer circumferential surface of itself, a liquid ejecting means for forming an image from photothermal conversion material on the heatsensitive stencil sheet by ejecting a liquid containing the photothermal conversion material to the heatsensitive stencil sheet and for forming an image on a printing paper by ejecting a liquid containing a material selected from the group including a colorant and the photothermal conversion material, a light radiating means for perforating the heatsensitive stencil sheet by radiating light to the heatsensitive stencil sheet with the photothermal conversion material transferred thereon, a pressing mechanism for pressing the printing paper which is supplied in synchronization with rotation of the printing drum against the printing drum and for transferring an ink supplied to an inner spherical surface of the printing drum to the printing paper through the perforated heatsensitive stencil sheet, which method comprises controlling diameters $R_1$,$R_2$ and distances $D_1$,$D_2$ so that the formula $D_1>R_1,R_2\geqq D_2$ is satisfied, where said diameter $R_1$ is a diameter of a dot of the liquid transferred to the heatsensitive stencil sheet, the diameter $R_2$ is a diameter of a dot of the liquid transferred to the printing paper, the distance $D_1$ Is a center distance between two dots adjacent to each other on the heatsensitive stencil sheet, and the distance $D_2$ is a center distance between two dots adjacent to each other on the printing paper.

The recording method as defined in the eighth aspect of the present invention comprises controlling said diameters $R_1$,$R_2$ so that the formula $R_2\geqq R_1$ is satisfied in the seventh aspect.

In the recording method defined in the ninth aspect of the present invention, wherein said image recorded on the heatsensitive stencil sheet is a reverse image and the image recorded on the printing sheet is a non-reverse image in the seventh aspect.

In the recording method as defined in the tenth aspect of the present invention, wherein said liquid ejecting means includes a sole ejecting head disposed selectively at either of a position for ejecting the liquid to the heatsensitive stencil sheet or a position for ejecting the liquid to the printing paper, thereby ejecting the liquid selectively to the heatsensitive stencil sheet or the printing paper in the seventh aspect.

In the recording method as defined in the eleventh aspect of the present invention, wherein the liquid ejecting means includes plurality of ejecting heads for respectively ejecting plurality of the liquid containing the colorants in different tones so that multicolor printing can be performed in the seventh aspect.

In the recording method as defined in the twelfth aspect of the present invention, wherein the heatsensitive stencil sheet includes thermoplastic resin film and liquid absorbent layer laminated on the thermoplastic resin film, which method further comprises ejecting the liquid on the absorbent layer of the heatsensitive stencil sheet by the liquid ejecting means, and causing the photothermal conversion material contained in the liquid to heat up by radiating light to the heatsensitive stencil sheet by means of the light radiating means, thereby perforating the thermoplasic resin film.

BRIEF DESCRIPTION OF THE DRAWINGS

FIG. 1(*b*) is a schematic cross sectional view showing a state of transferring a photothermal conversion material to a heatsensitive stencil sheet.

FIG. 1(*c*) is a schematic cross sectional view showing a state of radiating light to a heatsensitive stencil sheet with a photothermal conversion material transferred thereon.

FIG. 1(*d*) is a schematic cross sectional view showing a state of a heatsensitive stencil sheet perforated by radiating.

FIG. 2(*b*) is a schematic diagram showing a state of perforation in a heatsensitive stencil sheet.

FIG. 2(*c*) is a schematic diagram view showing diameters of dots recorded on a printing sheet by a liquid ejecting means.

FIG. 4(*b*) is a schematic diagram showing an image obtained on a printing paper by stencil printing.

FIG. 4(*c*) is a schematic diagram showing a character "F" directly recorded on a printing paper.

DETAILED DESCRIPTION OF PREFERRED EMBODIMENTS

Figure 1A:
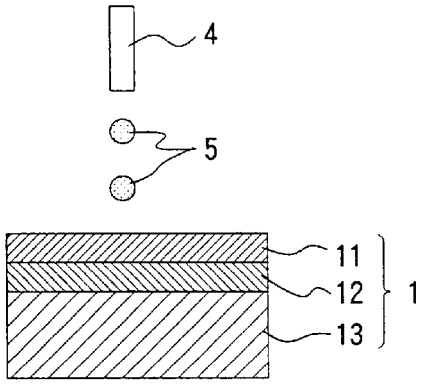
FIG. 1(*a*) is a schematic cross sectional view showing a state of ejecting a liquid containing a photothermal conversion material from a liquid ejecting means to a liquid absorbent layer of a stencil sheet in the present invention.
Figure 1B:
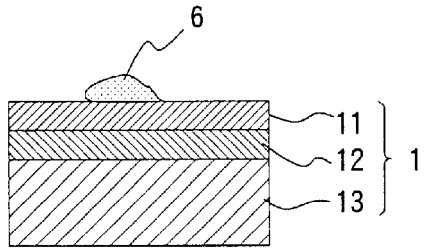
Figure 1C:
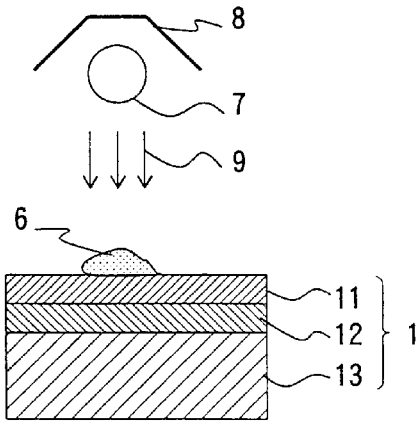
Figure 1D:
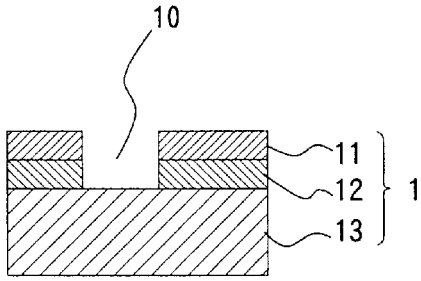

In a printing apparatus as defined in claims 1–6 and a recording method as defined in claims 7–12 using the printing apparatus, stencil printing can be performed after forming an image on a heatsensitive stencil sheet by a liquid ejecting means and perforating the stencil sheet by heating the image by means of a light radiating means. Further, direct printing on a printing paper can be conducted by using the liquid ejecting means. Namely, the present invention is characterized in that two printing methods, ie stencil printing and ink-jet printing, are available.

A case where an image is recorded on a heatsensitive stencil sheet in the printing apparatus will be explained. Firstly, a liquid containing a photothermal conversion material is ejected to a heatsensitive stencil sheet from a liquid ejecting means according to image data pre-converted into an electrical signal. The photothermal conversion material transfers to the heatsensitive stencil sheet, forming a reverse image on it (the first process). Next, a light radiating means radiates a visible ray or an infrared ray onto the heatsensitive stencil sheet, causing the photothermal conversion material to heat up, thereby selectively perforating the heatsensitive stencil sheet in a portion where the photothermal conversion material is transferred to (the second process).

Referring to FIG. 1, the principle of the perforating processes (the first process and the second process) of the heatsensitive stencil sheet in the present invention will be explained. A heatsensitive stencil sheet for use in stencil printing is usually comprised of a porous substrate and a thermoplastic resin film. In the present invention, such conventional heatsensitive stencil sheet thus mentioned can be used; however, it is also possible to use a heatsensitive stencil sheet comprising the porous substrate, the thermoplastic resin film, and a liquid absorbent layer which are successively overlaid with each other.

In FIG. 1(*a*), a heatsensitive stencil sheet 1 which is formed in three-layer structure of a liquid absorbent layer 11, a thermoplastic resin film 12, and a porous substrate 13 is illustrated. On the liquid absorbent layer 11 of the heatsensitive stencil sheet 1, a liquid 5 containing a photothermal conversion material is ejected from an ejecting head 4 of liquid ejecting means, thereby transferring onto the liquid absorbent layer 11 to form an image as shown in FIG. (b).

Next, as shown in FIG. 1(*c*), a light radiating means 7 having a light reflection mirror 8 radiates a visible ray or an infrared ray 9 on the liquid 6 which is transferred to the heatsensitive stencil sheet and formed an image of a pattern thereon. The photothermal conversion material is hardened and adhered to the heatsensitive stencil sheet 1, heating up. As shown in FIG.1(*d*), the liquid absorbent layer 11 and the thermoplastic resin film 12 are melted partially and a perforated hole 10 is formed, so that perforation is achieved.

Actually, the first process will be performed, for example, as follows: the ejecting head 4 is placed a little distance away from the heatsensitive stencil sheet 1, moving parallel with the heatsensitive stencil sheet 1 in a non-contact manner with it. While moving, the ejecting head 4 ejects drops of the liquid 5 onto the heatsensitive stencil sheet 1 according to an image information previously converted into an electrical signal. After the liquid 5 on the heatsensitive stencil sheet 1 evaporates, an image is reproduced in a reverse pattern. The image is a solid adhered to the heatsensitive stencil sheet 1, and the solid is comprised of a photothermal conversion material as a main ingredient. Namely, the image formed on the heatsensitive stencil sheet 1 is composed of a group of many dots of photothermal conversion material.

Actually, the second process will be performed, for example, as follows: when the light radiating means 7 radiates a visible light or an infrared light onto the heatsensitive stencil sheet 1 on which the photothermal conversion material transfers, the photothermal conversion material absorbs the light, thereby emitting heat. As a result, the thermoplastic resin film 12 of the heatsensitive stencil sheet 1 is heated and perforated, and so the heatsensitive stencil sheet 1 is directly perforated in a non-contact manner. As the light radiating means, there can be used a xenon lamp, a flash lamp, a halogen lamp or an infrared heater and the like.

In the recording method using the perforating/printing apparatus of the present invention, since the stencil sheet is not required to contact with anything like the thermal head and so on when being perforated, the heatsensitive stencil sheet does not crease in perforation.

Further, in the present invention, the first and the second processes may be optionally performed before or after attaching the heatsensitive stencil sheet to a printing drum.

In the printing apparatus, a case where an image is directly recorded on a printing sheet will be explained. The ejecting head 4 as the liquid ejecting means ejects a liquid containing said photothermal conversion material and/or a colorant onto the printing paper. The photothermal conversion material and/or the colorant transfers to the printing paper, forming a non-reverse image on it.

The liquid ejecting means for use in the printing apparatus is available for both perforation of the heatsensitive stencil sheet and direct recording on the printing sheet. As the liquid ejecting means, there can be used a means like a ejecting head including a nozzle having 10 to 2,000 apertures per one inch (10 to 2,000 dpi), slit, injector, porous member, porous film connected to piezoelectric device, heat generating device, electric field device or liquid feeding pump. The liquid can be discharged intermittently or continuously in accordance with character image signals.

Next, in the present invention, when the liquid is applied in a dot form by the liquid ejecting means on the heatsensitive stencil sheet and the printing paper, things to be considered concerning with a relation between a diameter of the dot and a center distance of the dots adjacent to each other will be explained referring to FIG. 2.

Figure 2A:
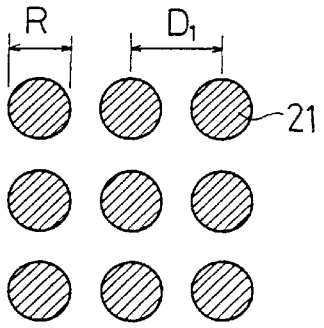
FIG. 2(*a*) is a schematic diagram showing a state of dots recorded on a heatsensitive stencil sheet by a liquid ejecting means.
Figure 2B:
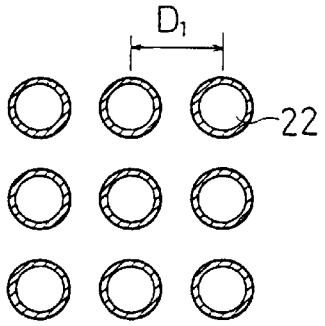
Figure 2C:
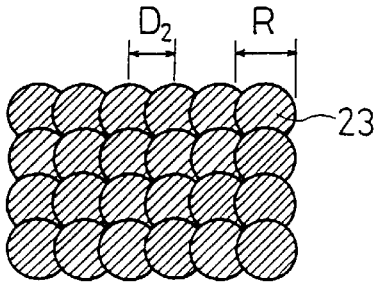

In the perforating method of the heatsensitive stencil sheet of the present invention, as shown in FIG. 2(*a*) and FIG. 2(*b*), the liquid containing the photothermal conversion material is transferred to the heatsensitive stencil sheet so that the formula $D_1>R$ is satisfied, where the R is a diameter of a dot 21 of the liquid on the heatsensitive stencil sheet, the $D_1$ is a center distance between the two dots 21,21 adjacent to each other on the heatsensitive stencil sheet. Once the diameter of the dot 21 and the center distance between the two dots 21,21 are thus arranged, a perforated portion of the heatsensitive stencil sheet will be formed in a substantially discontinuous pattern like a perforated portion 22 in the stencil sheet as shown in FIG. 2(*b*) after receiving a visible light or an infrared light on it. In stencil printing, by using such stencil sheet, printed matters of high quality with clarity and no set-off can be attained.

In the case where the relation between the diameter of the dot 21 and the center distance of the dots 21,21 is stipulated by the formula $D_1 \leqq R$, holes in the perforated portion of the heatsensitive stencil sheet are so formed by the radiation of the visible ray or the infrared ray to show a continuous pattern. As the result, the resolution deteriorates and a large amount of ink passes through the perforated portion, a faint image with bleeding is formed on the printed matter.

In direct recording on the printing paper in the present invention, as shown in FIG. 2(*c*), the liquid containing the photothermal conversion material and/or the colorant is transferred to the printing paper so that the formula $R \geqq D_2$ is satisfied, where the R is a diameter of a dot 23 of the liquid on the printing paper, the $D_2$ is a center distance between the two dots 23,23 adjacent to each other on the printing paper. Once the diameter of the dot 23 and the center distance of the dots 23,23 are thus arranged, dots 23 will be formed in a substantially continuous pattern, so printed matters with clarity and high density can be attained.

On the contrary, in direct recording on the printing paper, if the center distance between the dots among the image is larger than the diameter of the dot, density and resolution of the printed matter deteriorates. Namely, if the relation between the diameter R of the dot 23 and the center distance $D_2$ of the dots 23,23 is stipulated by the formula $R<D_2$, since an image on the printing paper is composed of dots which are arranged in a discontinuous manner, the resolution and the density of the image deteriorates.

In the present invention, it is preferable that the diameter of each hole in the perforated portion of the heatsensitive stencil sheet should be formed in a small enough size, since dots formed from an ink on the printing paper tend to become larger than the diameter of the holes after the ink passing through them. Consequently, when recording is conducted by ejecting the liquid on the heatsensitive stencil sheet, the diameter of the dot formed on the heatsensitive stencil sheet should be controlled to within a small enough size.

Therefore, in the present invention, the liquid ejecting means is controlled so that the formula $R_2 \geqq R_1$ is satisfied when ejecting the liquid, wherein the $R_1$ is a diameter of the dot 21 formed on the heatsensitive stencil sheet and the $R_2$ is a diameter of the dot 23 directly formed on the printing paper.

Now, the wording "recorded" as used in this specification comprises two meanings: one is that the liquid with the photothermal conversion material is transferred onto the heatsensitive stencil sheet, and the other is that the liquid with the photothermal conversion material and/or the colorant is transferred onto the printing paper. Further, if the dot does not show a complete circle form, the average of the length and the breadth of the dot can determine the diameter R of the dot. The diameter R of the dot actually formed is generally within a range from 10 $\mu$m to 2000 $\mu$m, although this is variable with the diameter of a nozzle in the ejecting head. Further, the dots adjacent to each other means a pair of dots which are positioned next to each other in an area where the dots are most thickened in an image. Further, the image is a conception that includes characters, pictures and so on.

In the present invention, when the heatsensitive stencil sheet is perforated by recording with the liquid containing the photothermal conversion material, a reverse image, ie left-right reversed image, is recorded on the heatsensitive stencil sheet according to an image information which is pre-converted into an electrical signal.

The heatsensitive stencil sheet for use in the present invention may be an existent heatsensitive stencil sheet that is formed with a thermoplastic resin film laminated on a porous substrate. However, as described beforehand, the stencil sheet comprising the liquid absorbent layer further laminated on the thermoplastic resin film can also be used. In the present invention, the perforated heatsensitive stencil sheet is wrapped around an outer circumferential surface of an ink-permeable printing drum, where the porous substrate of the stencil sheet is set to be inside and the thermoplastic resin film outside. Ink in the printing drum passes through the porous substrate and the perforated portion of the thermoplastic resin film, thereby transferring to the printing paper. Therefore, if a non-reverse image is perforated on the heatsensitive stencil sheet, the print image attained by stencil printing will be a left-right reversed image. Hence, the heatsensitive stencil sheet must be recorded in a reverse image.

On the other hand, in recording by transferring the liquid containing the photothermal conversion material and/or the colorant onto the printing paper, a non-reversed image is recorded on the printing paper according to an image information that is pre-converted into an electrical signal.

In the printing apparatus of the present invention, liquid ejecting means for forming an image on the heatsensitive stencil sheet and liquid ejecting means for forming an image on the printing paper may be provided separately, or sole liquid ejecting means for both use may be commonly provided. In the case where a common liquid ejecting means is solely provided, such liquid ejecting means should consist of sole ejecting head which is selectively arranged at either a position for ejecting the liquid to the heatsensitive stencil sheet or a position for ejecting the liquid to the printing paper, thereby selectively ejecting the liquid on the heatsensitive stencil sheet or the printing paper. Further, a liquid ejecting means comprising a plural liquid ejecting head may be provided. In such case, each liquid ejecting head is arranged to be capable of ejecting a liquid containing the colorant in different tones on the printing paper, thus conducting a multiple color printing by ejecting the liquids with different colorants on a common printing paper. Further, a liquid ejecting means comprising sole liquid ejecting head may be provided. In such case, the sole liquid ejecting head is arranged to be capable of selectively ejecting a plural liquid with the colorants in different tones.

As has been described above, in the present invention, when printing for a great number of sheets is required, the liquid ejecting means ejects the liquid with the photothermal conversion material onto the heatsensitive stencil sheet, the light radiating means perforating the stencil sheet, so that stencil printing can be conducted by using the perforated heatsensitive stencil sheet. Further, when printing for a small number of sheets is required, such printing can be easily conducted by directly ejecting the liquid containing the photothermal conversion material and the colorant onto a printing paper. That is to say, both types of printing for a great number of sheets and a small number of sheets can be conducted efficiently just by controlling the liquid ejecting means after providing the one printing apparatus with one kind of printing paper and the heatsensitive stencil sheet.

Further, multiple color printing and process color printing can also be conducted by overlapping images on a printing sheet by using the liquid ejecting means. Still further, printing with black ink of high frequency in use is conducted by stencil printing, and printing with red, blue, yellow and so on of low frequency in use is effected directly on a printing paper, so that efficiency of the process color printing can be improved.

The photothermal conversion material used in the present invention should be such a material that light energy can be efficiently converted into thermal energy. As a material with high efficiency in photothermic conversion, there can be mentioned, for example, inorganic pigments such as carbon black silicon carbide, silicon nitride, metal powder, metallic oxide; organic pigments; and organic dyes. As carbon black, there can be mentioned furnace black, channel black, lamp black, acetylene black, oil black and so on. Among organic dyes, a material showing intense absorption in a specific range of wavelength is preferable, such as anthraquinone type, phthalocyanine type, cyanin type, squalelium type, and polymethyn type.

Further, if the photothermal conversion material has its own color, the colorant ejected from the liquid ejecting head onto the printing paper may be the same one as the photothermal conversion material. As the colorant, there can be mentioned, for example, organic or inorganic pigments such as carbon black, copper phthalocyanine blue, victoria blue, brilliant carmin 6B, permanent red F5R, rhodamine lake B, benzine yellow, hansa yellow, naphthol yellow, titanium oxide, and calcium carbonate; pigments such as azo type, anthraquinone type, quinacridone type, xanthene type, and acridine type.

As a liquid containing the photothermal conversion material and the colorant, there can be mentioned aliphatic hydrocarbon type, aromatic hydrocarbon type, alcohol, ketone type, ester type, ether type, aldehyde type, carbonic acid type, amine type, low molecular heterocyclic compound, oxide type and water. As a concrete example, there can be mentioned, hexane, heptane, octane, benzene, toluene, xylene, methanol, ethanol, isopropanol n-propanol butanol, ethylene glycol, diethylene glycol, propylene glycol, glycerine, acetone, methyl ethyl ketone, ethyl acetate, propyl acetate, ethyl ether, tetrahydrofuran, 1,4-dioxane, formic acid, acetic acid, propionic acid, formaldehyde, acetoaldehyde, methyldiamine, dimethylformamide, pyridine and ethylene oxide. They may be used alone or in combination. Further, the liquid may optionally contain dye, pigment, filler, binder, curing agent, corrosion inhibitor, wetting agent, surfactant and pH controller.

The liquid containing the photothermal conversion material and the liquid containing the photothermal conversion material and/or the colorant can be prepared by adequately dispersing and mixing the listed material into the listed liquid in such a manner that the material can pass through the liquid ejecting means.

The heatsensitive stencil sheet used in the present invention should be such that it can be melted and perforated by heating of the photothermal conversion material after the material transferring on it. A heatsensitive stencil sheet consisting of only the thermoplastic resin film can be used. The heatsensitive stencil sheet having the thermoplastic resin film and the porous substrate laminated thereon can also be used.

As such thermoplastic resin film, there may be used, for example, polyethylene, polypropylene, polyvinyl chloride, polyvinylidene chloride, polyethylene terephthalate, polybutylene terephthalate, polystyrene, polyurethane, polycarbonate, polyvinyl acetate, acrylate resin, silicon resin and so on. The resin may be used alone or in admixture, or may be used as a copolymer. The thickness of the thermoplastic resin film is desirably within a range from 0.5 to 50 $\mu$m, preferably, within a range from 1 to 20 $\mu$m. If the thickness is less than 0.5 $\mu$m, the strength and the handling feeling of the resin layer is insufficient. If it exceeds 50 $\mu$m, it requires a great amount of heat for perforating the resin layer. This is not economical.

As the porous substrate, there can be mentioned thin sheet paper, nonwoven fabric and screen silk gauze, which are manufactured alone or in admixture from natural fibers such as Manila hemp, pulp, mitsumata, paper mulberry, Japanese paper; synthetic fibers such as polyester, nylon, vinylon and acetate; metal fibers and glass fibers, etc. The unit weight of the porous substrate is preferably within a range from 1 to 20 g/m$^2$, more preferably within range from 5 to 15 g/m$^2$. If it is less than 1 g/m$^2$, the strength as the stencil paper is deteriorated. If it exceeds 20 g/m$^2$, ink passage upon printing may be deteriorated. Further, the thickness of the porous substrate is preferably within a range from 5 to 100 $\mu$m and, more preferably, within a range 10 to 50 $\mu$m. If it is less than 5 $\mu$m, the strength as the stencil paper is also deteriorated. If it exceeds 100 $\mu$m, the ink passage upon printing may be worsened.

In the present invention, it is preferable to form the liquid absorbent layer on the surface of the heatsensitive stencil sheet for receiving the liquid ejected in order to prevent bleeding of the liquid and to facilitate drying the same, so that the heatsensitive stencil sheet can be perforated precisely according to an image information thereby to obtain a clear printed matter.

The liquid absorbent layer is preferably provided on the outer surface of the heatsensitive stencil sheet so as to form a resin layer which is melted and perforated like the thermoplastic resin film by being radiated. The liquid absorbent layer can be constituted of any material provided that the material can prevent the liquid ejected on the stencil sheet from spreading out and fix the photothermal conversion material on the thermoplastic resin film. Preferably, the liquid absorbent layer is constituted of a material that shows strong affinity with the liquid to be used. For example, if the liquid is water type, there can be used polyvinyl alcohol methyl cellulose, carboxymethyl cellulose, hydroxyethyl cellulose, polyvinyl pyrrolidone, ethylene-vinylalcohol copolymer, polyethylene oxide, polyvinylether, polyvinylacetal, polyacrylamid, and so on. The resin may be used alone or in admixture, or may be used as a copolymer.

Further, if the liquid is organic solvent, there can be used, for example, polyethylene, polypropylene, polyisobutylene, polystyrene, polyvinyl chloride, polyvinylidene chloride, polyvinyl fluoride, polyvinyl acetate, acrylate resin, polyamide, polyimide, polyester, polycarbonate, polyurethane, silicon resin, fluororesin and so on. The resin may be used alone or in admixture, or may be used as a copolymer.

Further, the liquid absorbent layer can contain both organic and inorganic particles. For example, there can be mentioned organic particles such as polyurethane, polyester, polyethylene, polystyrene, polysiloxane, phenol aldehyde resin, acryle resin, benzoguanamine resin, silicon resin, fluororesin, polyethylene wax, paraffin wax and so on; also inorganic particles such as talc, clay, calcium carbonate, titanium oxide, aluminium oxide, silicon dioxide, kaolin, and so on.

The liquid absorbent layer can be obtained by mixing said high molecular compound and the optionally selected particles so as to form a liquid, coating the liquid on the heatsensitive stencil sheet by an applying means such as a gravure coater, a wire bar coater, etc., and then drying the liquid.

In the present invention, the perforated heatsensitive stencil sheet is wrapped around the outer circumferential surface of an ink-permeable printing drum of a cylindrical shape. The printing paper is supplied in synchronization with rotation of the drum. At least either one of the drum and the printing paper is pressed against the other by a pressing mechanism, so that the drum and the paper contact tightly. The printing paper is sandwiched between the drum and the pressing mechanism and transported. During the transportation of the printing paper, an ink which is applied to the inner surface of the printing drum passes through the perforated portion (perforated portion) to transfer onto the printing paper, so that printing is completed.

The printing drum of the present invention comprises an ink-permeable porous member that is formed in a cylindrical shape. As an ink-permeable porous member, there can be mentioned, for example, metallic fiber, synthetic fiber, porous metal, high polymer porous material and so on.

The pressing mechanism may be a press roller disposed outside and against the printing drum for pressing the outer circumferential surface of the drum. Further, the printing drum may be composed of a flexible material a squeeze roller or a blade as the pressing mechanism may be movably disposed inside the printing drum, and a paper roller may be disposed outside the drum, being parallel with it. In this case, the printing drum deforms outwardly when the pressing mechanism contacts with the inner surface of the drum and presses it outwardly. The deformed printing drum sandwiches the printing paper relative to the paper roller.

As the ink supplied inside the printing drum for stencil printing, an ink used generally for stencil printing, such as oily ink, aqueous ink, water-in-oil droplet (W/O) type emulsion ink, oil-in-water (O/W) type emulsion ink, heat-melting ink and so on can be utilized.

Referring to the drawings, the present invention will be explained more specifically.

Figure 3:
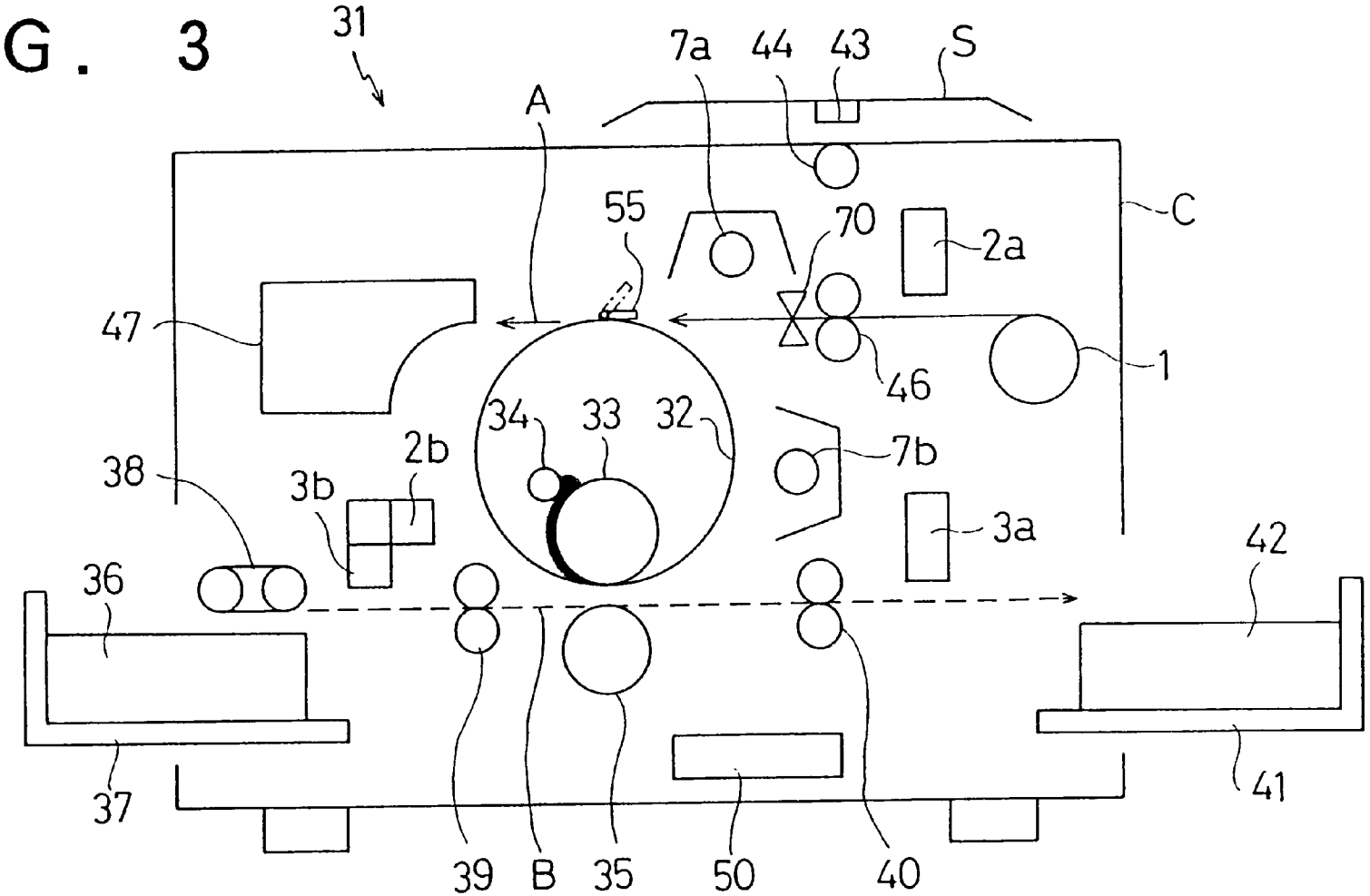
FIG. 3 is a schematic cross sectional view showing an inner structure of a printing apparatus in the present invention.

FIG. 3 is a schematic cross sectional view showing an inner structure of a printing apparatus 31 in the present invention. In a casing C, there is provided a printing drum 32. In the printing drum 32, there is provided a rotary squeegee roller 33 contacting the inner surface of the drum and a doctor roller 34 providing a certain amount of a printing ink with the squeegee roller 33. The squeegee roller 33 and the doctor roller 34 are disposed parallel with each other at a certain distance. Just beneath the printing drum 32, a press roller 35 is placed parallel with the drum in a position facing to the squeegee roller 33. The press roller 35 is vertically movable, selectively contacting with or leaving from the outer surface of the drum 32. On one part of the surface of the printing drum 32, there is provided a pivotally movable clamping means 55. The clamping means 55 holds one end of the heatsensitive stencil sheet wrapped around the printing drum 32. In stencil printing, the printing drum 32 rotates anticlockwise in FIG. 3. On the left-side surface of the casing C in the drawing, there is provided a paper feed tray 37 for feeding printing paper 36. A paper feed mechanism 38 is disposed above the paper feed tray 37. The paper feed mechanism 38 comprises a pair of rollers and an endless belt connecting the rollers. The paper feed mechanism 38 sends a printing paper stacked on the paper feed tray 37 one by one in a direction for the printing drum 32. Timing rollers 39 consisting of a pair of an upper roller and a lower roller are disposed beside the paper feed mechanism 38. In printing, the printing paper 36 is sent by the paper feed mechanism 38 and further supplied between the printing drum 32 and the press roller 35 by the timing rollers 39 in synchronization with rotation of the printing drum 32. Discharge rollers 40 consisting of a pair of rollers are disposed to the right of the printing drum 32 in the drawing. A discharge tray 41 is disposed on the right side of the casing C in the drawing. The printed paper 42 is conveyed to the discharge tray 41 by the discharge rollers 40 after being printed and sent out from between the printing drum 32 and the press roller 35.

In FIG. 3, a covering body S is disposed to the upper of the casing C. An image sensor 43 is attached to the bottom surface of the covering body S. On the top surface of the casing C, an original feed roller 44 is disposed. When an original is supplied between the original feed roller 44 and the image sensor 43 from outside the covering body S, the original is read by the image sensor 43 while being conveyed so that an image information converted into an electrical signal can be obtained.

Further, beneath the original feed roller 44 in the casing C, the heatsensitive stencil sheet 1 rolled up is rotationally installed around an axis by an appropriate heatsensitive stencil sheet holding means. Between the heatsensitive stencil sheet 1 and the printing drum 32, there is provided a stencil feed rollers 46 consisting of a pair of upper and lower opposite rollers. The heatsensitive stencil sheet 1 is conveyed by the stencil feed rollers 46 in a direction for the printing drum 32. Further, on the opposite position of the heatsensitive stencil sheet 1 relative to the printing drum 32, a discharge box 47 is disposed for receiving used stencil sheets discarded from the printing drum 32. And, between the printing drum 32 and the stencil feed roller 46, a cutter 70 is disposed. After the heatsensitive stencil sheet of a unit length for one perforating operation is conveyed to the printing drum 32, the cutter 70 cuts the heatsensitive stencil sheet.

In the printing apparatus 31 of FIG. 3, the ejecting head of the liquid ejecting means for ejecting the photothermal conversion material onto the heatsensitive stencil sheet 1 may be disposed, like an ejecting head 2*a* shown in the drawing, along a conveying route A through which the heatsensitive stencil sheet 1 reaches out to the printing drum 32 so as to direct to the stencil sheet 1 in the route A. Further, the ejecting head, like a ejecting means 2*b*, may be disposed to direct to the printing drum 32.

Further, in the printing apparatus 31 of FIG. 3, the light radiating means 7 for perforating the heatsensitive stencil sheet 1 with the photothermal conversion material transferred thereon may be disposed, like a light radiating means 7*a* shown in the drawing for example, along the conveying route A through which the heatsensitive stencil sheet 1 reaches out to the printing drum 32 so as to direct to the stencil sheet 1 in the route. A Further, the light radiating means, like a light radiating means 7*b* shown in the drawing, may be directed to the printing drum 32.

Still further, in the printing apparatus 31 of FIG. 3, the ejecting head of the liquid ejecting means for directly printing images on the printing paper 36, like an ejecting head 3*a* shown in the drawing, may be disposed to the downstream side relative to the printing drum 32 in a conveying route B of the printing paper so as to direct to the printing sheet 36 in the route B. Further, the ejecting head, like a ejecting head 3*b* shown in the drawing, may be disposed to the upstream side relative to the printing drum 32 in the conveying route B of the printing paper so as to direct to the printing paper 36 in the route B.

In the printing apparatus 31 of FIG. 3, as the liquid ejecting means for perforating the heatsensitive stencil sheet 1, both or either one of the ejecting heads 2*a*, 2*b* may be disposed to it. Further, for example, if the ejecting head 2*b* is arranged to be changeable in direction so as to take the position of the ejecting head 3*b*, it can be optionally posed either in a position directing to the printing drum 32 or in a position directing to the printing paper 36, so that both of perforating the heatsensitive stencil sheet 1 and direct printing on the printing paper 36 can be conducted by the sole ejecting head 2*b*. Further, if the ejecting head 2*a* is arranged to be capable of moving to the position of the ejecting head 3*a*, it can be optionally posed either in a position directing to the heatsensitive stencil sheet 1 or in a position directing to the printing paper 36, so that both of perforating the heatsensitive stencil sheet 1 and direct printing on the printing paper 36 can be conducted by the sole ejecting head 2*a*.

In the printing apparatus 31 of FIG. 3, a case where direct printing is conducted after reading an original will be explained. An original is inserted under the covering body S. The original is read by the image sensor 43 to generate an electrical signal of the original while being conveyed by the original feed roller 44. The original image is reproduced on the heatsensitive stencil sheet 1 or on the printing paper 36 by controlling the move of the ejecting head and the ejection of the liquid according to the electrical signal. Further, the original image can be reproduced by directly controlling the move of the ejecting head according to an image information stored in a personal computer (not shown).

A case where printing for a small number of sheets is conducted on the printing paper 36 will be explained. The press roller 35 is set at a distance from the printing drum 32. The printing paper 36 on the paper feed tray 37 is conveyed by the paper feed mechanism 38 and the timing roller 39. Then, the liquid containing the photothermal conversion material and/or the colorant is ejected from the liquid ejecting means (the ejecting means 3*a* or 3*b*) directly onto the printing paper 36, so that an image is reproduced on the printing paper 36. The printed paper 42 is stacked on the discharge tray 41.

In order to conduct printing in color on the printing paper 36, plural ejecting heads may be provided with the liquid ejecting means, so that liquids with colorants in different tones can be ejected from each ejecting head onto the printing paper 36. For example, the ejecting means may be those referred by references 3*a* and 3*b* in FIG. 3, each ejecting head may eject a liquid containing different colorant in tones, so that printing in two colors can be performed.

A case where printing for a great number of sheets is conducted on the printing paper 36 will be explained. The liquid with the photothermal conversion material is ejected onto the heatsensitive stencil sheet 1 by the ejecting means 2*a* shown in the drawing while the stencil sheet 1 is conveyed to the printing drum 32 by the stencil feed roller 46, so that an image is reproduced on the heatsensitive stencil sheet 1. Next, the light radiating means 7*a* radiates a visible light or an infrared light onto the heatsensitive stencil sheet 1, so that the heatsensitive stencil sheet 1 is perforated. The perforated heatsensitive stencil sheet 1 is wrapped around the printing drum 32.

Further, this perforation may be conducted by radiating a visible light or an infrared light from the light radiating means 7*b* after the heatsensitive stencil sheet 1 is wrapped around the printing drum 32. Further, since the heatsensitive stencil sheet 1 of the present invention can be perforated in a non-contact manner, perforation process of the stencil sheet 1 may be conducted by wrapping the stencil sheet around the printing drum 32, ejecting the liquid with the photothermal conversion material on the stencil sheet by the ejecting head 2*b*, and finally radiating a visible light or an infrared light on the stencil sheet 1 secured on the printing drum 32 by the light radiating means 7*b*.

The printing drum 32 with the perforated heatsensitive stencil sheet 1 wrapped around the outer circumferential surface rotates anticlockwise around its axis in the drawing. To the inner surface of the printing drum 32, a stencil printing ink is supplied by the doctor roller 34 and the squeegee roller 33. The paper feed mechanism 38 and the timing rollers 39 convey the printing paper 36 in synchronization with rotation of the printing drum 32. This printing paper 36 is forced to closely contact with the printing drum 32 by the press roller 35. The stencil printing ink passes through the perforated portion of the heatsensitive stencil sheet 1 and transfers on the printing paper 36, so that printing is completed. Next, the printing paper 36 is conveyed to the discharge tray 41 by the discharge rollers 40 and stacked there as the printed paper 42.

In order to obtain a printed matter on which direct printing by the liquid with the colorant and stencil printing are both effected, after stencil printing is conducted by pressing the printing sheet 36 on the printing drum 32 by means of the press roller 35, the identical printing sheet is again printed directly by the ejecting means 3*a* or 3*b*.

In order to conduct such printing, there may be provided and used the sole ejecting head which moves to the position of the ejecting head 2*a* shown in the drawing during stencil printing and also moves to the position of the ejecting head 3*b* shown in the drawing during direct printing. Further, a sole ejecting head pivotally arranged may be provided and used, so that it can be set in the direction of the ejecting head 2*b* shown in the drawing during stencil printing and also can be set in the direction of the ejecting head 3*b* shown in the drawing during direct printing.

However, having plural ejecting means is preferable for the purpose of obtaining a printed matter of multi-color. The printing process in this case will be explained. For example, printing is conducted on the printing paper 36 either by direct printing or by stencil printing. Then the discharge tray 41 is stacked with the printed paper 42. After the printed paper 42 is conveyed to the paper feed tray 37 and piled up there again as the printing paper 36, the other type of printing is conducted. Otherwise, if direct printing is conducted by the ejecting head 3*b* or 3*a* respectively before and after the printing paper 36 is printed by the printing drum 32, both stencil printing and direct printing can be conducted on the identical printing paper 36 during one process for sending the printing paper 36 from the paper feed tray 37 to the discharge tray 41.

The printing apparatus 31 shown in FIG. 3 will be explained more specifically.

The heatsensitive stencil sheet 1 of this embodiment will be explained. A surface of a polyethylene terephtalate film in a thickness of 2 $\mu$m is coated by a wire bar with a mixture composed of 1 weight % polyvinyl butyral, 2 weight % fluorine contained resin powder, 50 weight % water, and 47 weight % isopropyl alcohol. Then, the mixture is dried to form a liquid absorbent layer in a thickness of 0.5 $\mu$m on one surface of the stencil sheet. Next, a Japanese paper of a basis weight (unit weight) of 10 g/m$^2$ is appended to the other surface of the stencil sheet, so that the heatsensitive stencil sheet 1 is completed.

Stencil printing is conducted by using the heatsensitive stencil sheet 1. The heatsensitive stencil sheet 1 is sent out at a speed of 2 cm/sec. The liquid containing the photothermal conversion material is ejected on the heatsensitive stencil sheet 1 from a piezoelectric device as the ejecting head 2*a* thereby to form a character image on it. The liquid is composed of 3 weight % carbon black, 50 weight % water, 30 weight % diethylene glycol and 17 weight % 2-pyrolidone. The ejection of the liquid is controlled in such a manner that the liquid forms dots on the stencil sheet 1, the diameter of each dot is 60 $\mu$m, and the center distance of the dots situated adjacent to each other is 100 $\mu$m , so that a reverse character image is recorded on the liquid absorbent layer of the heatsensitive stencil sheet 1. By energizing a xenon lamp as the light radiating means 7*a* at an output energy of 7 J/cm$^2$ to radiate light on the heatsensitive stencil sheet 1, holes of 70 $\mu$m are formed discontinuously on the stencil sheet in a separate manner.

Figure 4A:
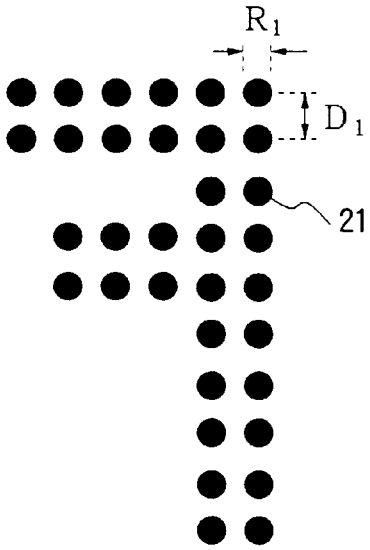
FIG. 4(*a*) is a schematic diagram showing a reverse image (left-right reversed image) of a character "F" recorded on a heatsensitive stencil sheet.
Figure 4B:
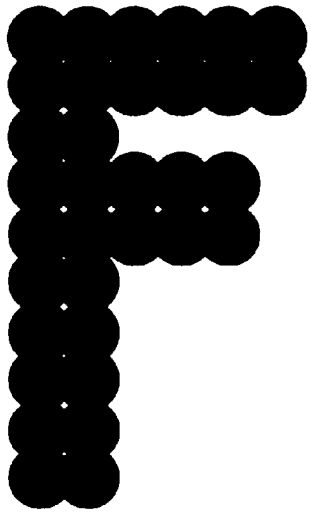
Figure 4C:
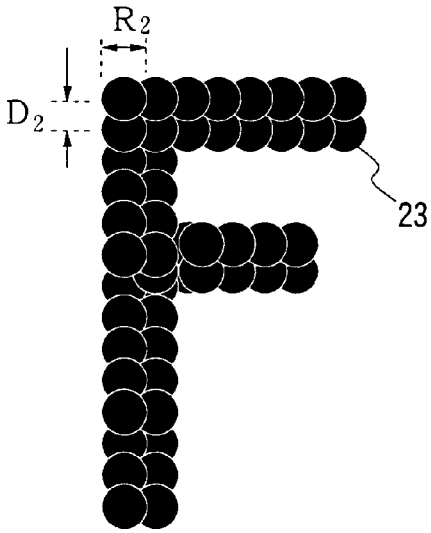

FIG. 4(*a*) shows a case where the liquid is ejected on the heatsensitive stencil sheet on the condition stated above to form a character "F" for stencil printing. The diameter $R_1$ of the dot formed from the liquid on the heatsensitive stencil sheet is set to be 60 $\mu$m; the diameter of the hole perforated in the heatsensitive stencil sheet by radiating light on it is set to be 70 $\mu$m; the center distance $D_1$ of the dots 21,21 situated adjacent to each other on the heatsensitive stencil sheet is set to be 100 $\mu$m; therefore, the center distance $D_1$ of the dots 21,21 on the stencil sheet is larger than the diameter $R_1$ of the dot itself and the diameter of the perforated hole. Hence, as shown in FIG. 4(*a*), the perforated portion of the heatsensitive stencil sheet is formed in substantially discontinuous pattern.

Next, the heatsensitive stencil sheet 1 is wrapped around the printing drum 32. A printing ink named "RISO GR ink" (a trademark of RISO Corporation) is supplied inside the printing drum 32. The paper feed tray 37 is stacked with printing papers of A4 size. Stencil printing is conducted at a speed of 100 sheets per minutes. In stencil printing by using this stencil sheet, high quality printing with clarity and no set-off is attained as shown in FIG. 4(*b*).

Direct printing is conducted on the printing paper. The ejecting head 2*a* is moved to the position of the ejecting head 3*a*. The ejecting head is controlled in such a manner that the diameter of the dot is set to be 70 μm and the center distance of the dots is set to be 50 μm. A non-reverse character image is recorded on the printing paper 36 at a speed of 5 sheets per minutes. The diameter of the dot in direct printing is larger than that of the dot formed on the heatsensitive stencil sheet.

FIG. 4(*c*) shows a case where the liquid is ejected on the printing paper on the condition stated above to form a character "F" in direct printing. The diameter $R_2$ of the dot formed from the liquid on the printing paper is set to be 70 μm; the center distance $D_2$ of the dots 23,23 situated adjacent to each other on the printing paper is set to be 50 μm; therefore, the center distance $D_2$ of the dots 23,23 on the printing paper is smaller than the diameter $R_2$ of the dot itself. Hence, the dots on the printing paper overlap one another to form a successive pattern so that a printing result of clarity and intense density is attained as shown in FIG. 4(*c*).

Next, referring to the drawings from FIG. 5 to FIG. 7, explanation will be made to a control method of the printing apparatus 31 in this embodiment.

Figure 5:
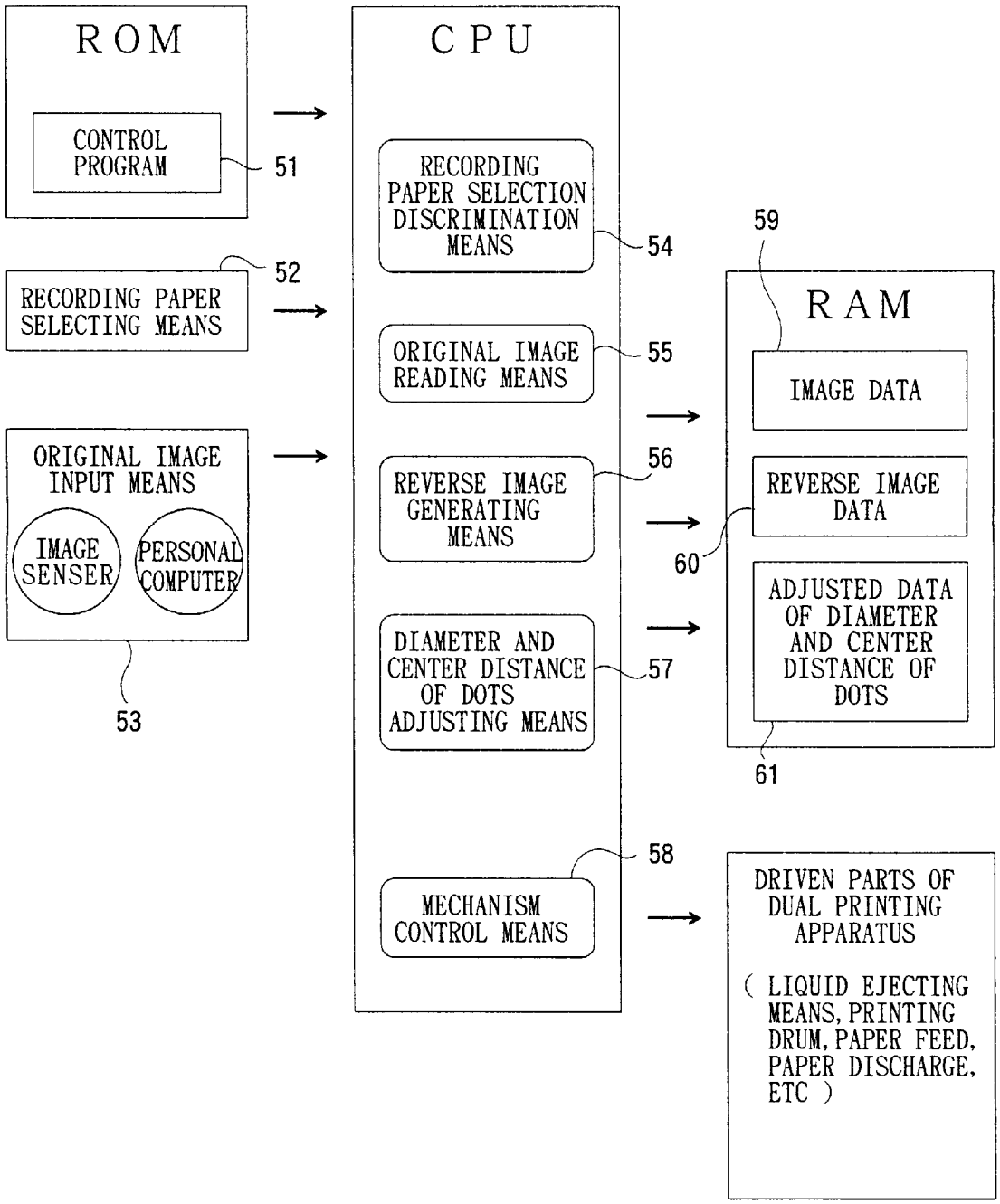
FIG. 5 is a block diagram showing a control means of a printing apparatus in the present invention.
Figure 6:
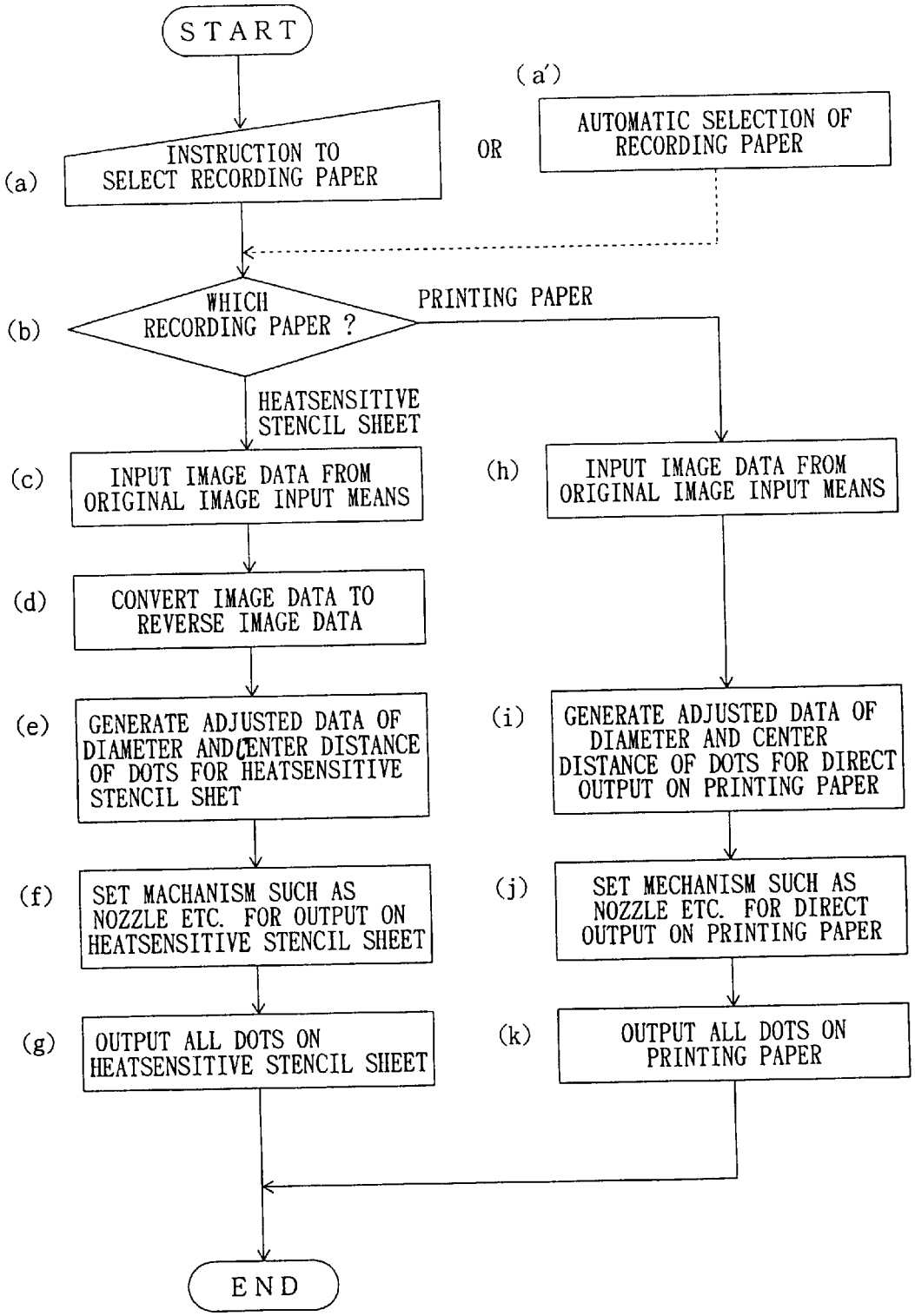
FIG. 6 is a flow chart showing processes for controlling a printing apparatus in the present invention.

FIG. 5 shows a constitution of a control means of the printing apparatus 31 in this embodiment. The control means comprises ROM, CPU, and RAM. The control means may be included inside a main body of the printing apparatus 31 as image data controller 50 as shown in FIG. 3. The control means also may be disposed outside the apparatus 31 as an external device (not shown).

The ROM stores a control program 51. A recording paper selecting means 52 is composed of an input means such as a keyboard and so on provided to the main body of the printing apparatus 31. The recording paper selecting means 52 selects either stencil printing by the heatsensitive stencil sheet or direct printing on the printing paper. An original image input means 53 in this embodiment comprises the image sensor 43, an external personal computer holding image data in its memory, etc.

The CPU comprises many types of function achievement means. A recording paper selection discriminating means 54 selects a function of this apparatus from either stencil printing or direct printing according to a signal from the recording paper selecting means 52. An original image reading means 55 reads out image data from the original image input means 53. A reverse image generating means 56 generates reverse image data converted from original image data for perforating the heatsensitive stencil sheet. An adjusting means 57 for diameter and center distance of dots decides the diameter and the center distance of the dots formed from the liquid on the heatsensitive stencil sheet and the printing paper. A mechanism control means 58 controls driven part (the liquid ejecting means, the printing drum 32, a paper feed apparatus, a paper discharge apparatus, etc.) of the printing apparatus 31 in this embodiment.

The RAM stores image data 59 input, reverse image data 60 gained by converting the image data 59, and diameter and center distance of dots adjusted data 61.

Explanation will be made to a process for printing by the printing apparatus 31 in this embodiment with reference to FIG. 6. The parenthetic alphabet corresponds to each step in a flow chart of FIG. 6.

Either one choice or the other of using the liquid ejecting means is made in step (b), namely the liquid ejecting means is applied either to perforating the heatsensitive stencil sheet or to direct printing on the printing paper. This choice may be made by manually selecting the heatsensitive stencil sheet or the printing paper through a control panel (not shown) of the printing apparatus 31 as shown in step (a). This choice also may be made by automatically selecting the heatsensitive stencil sheet or the printing paper as shown in step (a') according to the number of sheets required to be printed. Otherwise, the liquid ejecting means may be controlled so as to perforate the heatsensitive stencil sheet 1 automatically after the image sensor 43 reads the original The assumption is made that the heatsensitive stencil sheet is selected at step (b). At step (c), image data is input by the original image input means 53 such as the image sensor 43 or a personal computer (not shown). At step (d), the image data is converted into reverse image data. At step (e), data deciding the diameter and the center distance of the dots is generated. According to the data, the dots are formed with the liquid ejected by the ejecting head 2*a* during perforation of the heatsensitive stencil sheet, for example. At step (f), control of the mechanism is effected so that the position of the ejecting head corresponding to perforation of the heatsensitive stencil sheet, rotation of the printing drum 32, feed and discharge of the heatsensitive stencil sheet are properly controlled. At step (g), the ejecting head ejects the liquid onto the heatsensitive stencil sheet, the process entering a perforation phase.

The assumption is made that direct printing on the printing paper is selected at step (b). At step (h), image data is input by the original image input means 53. At step (i), data deciding the diameter and the center distance of the dots is generated. According to the data, the dots are formed with the liquid ejected on the printing paper by the ejecting head 2*a*, for example. At step (j), control of the mechanism is effected so that the position of the ejecting head corresponding to direct printing on the printing paper, feed and discharge of the printing paper etc. are properly controlled. At step (k), the ejecting head ejects the liquid onto the printing paper for recording.

Figure 7:
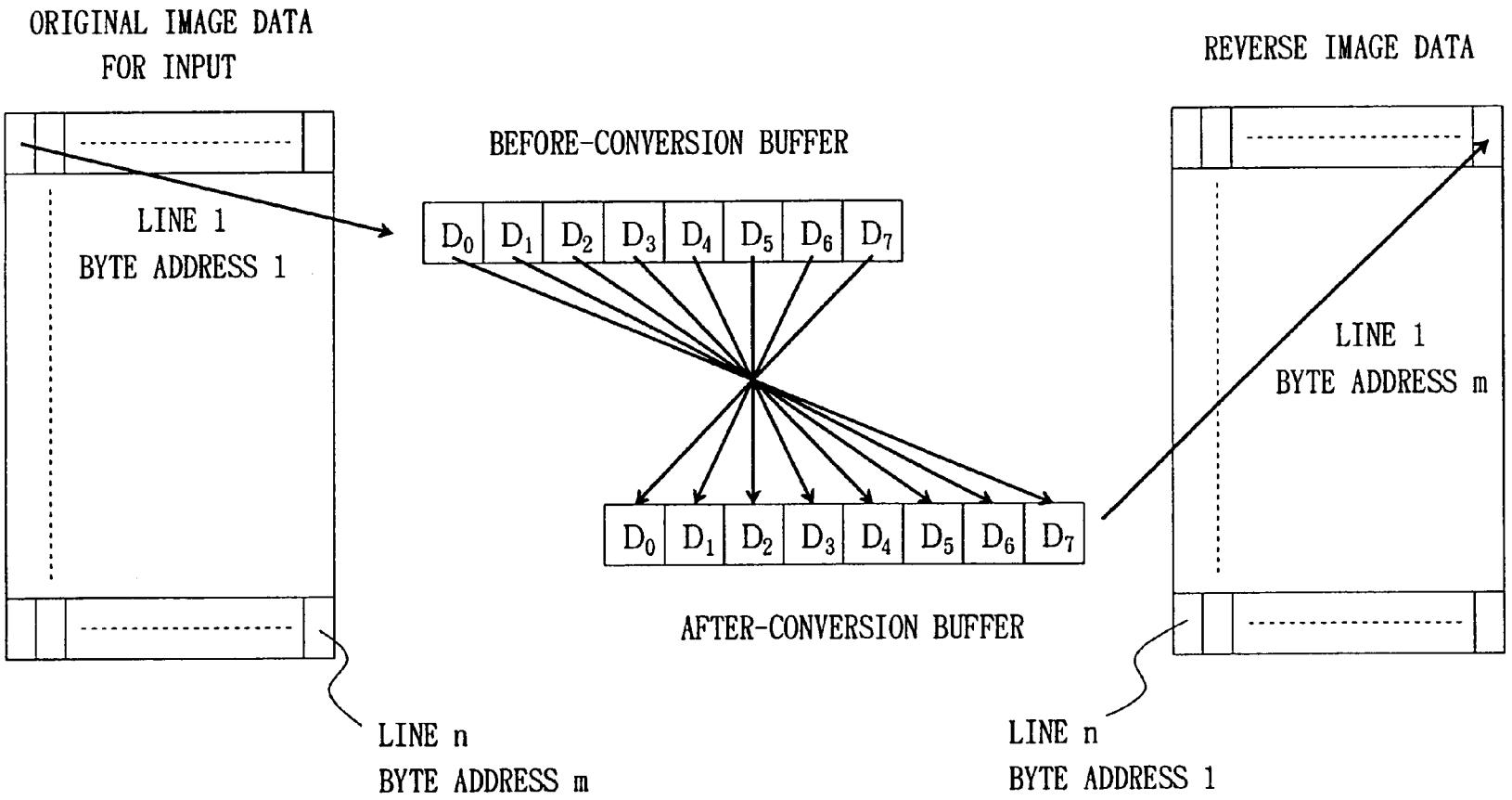
FIG. 7 is a schematic diagram showing a method for generating reverse data in processes for controlling a printing apparatus in the present invention.

Referring to FIG. 7, explanation will be made to step (d) in the control process explained above, specifically to a method of generating reverse data from input image data.

As shown in FIG. 7, byte data stored in byte address 1 on line 1 of input original image data is read, and the byte data is written in a before-conversion buffer by the byte. Next, the bit order in the byte data between the most significant data and the least significant data is reversed. Namely, each byte data corresponds to 8 bit data comprising digits from $D_0$ to $D_7$, and each digit combination of $D_7$ and $D_0$, $D_6$ and $D_1$, $D_5$ and $D_2$, and, $D_4$ and $D_3$ are respectively reversed in the byte data. The reversed byte data is written in an after-conversion buffer by the byte. The byte data stored in the after-conversion buffer is written in byte address m on line 1 of an image data storage region. Successively, input original image data (byte address 2 on line 1) is converted in the last bit-come first manner, and the byte data is written in the image data storage region (byte address m−1 on line 1). Afterwards, the rest of the byte data on line 1 of the input original image data is successively processed and written in the reverse image storage region until the last byte data on line 1 (byte address m) of the original image data is reversed and written in byte address 1 on line 1 of the reverse image storage region, so that the processing of line 1 of the original image data is completed. Afterwards, each line of the original image data is processed in the same way, until the last byte data on line n (byte address m) of the original image data is converted and written in byte address 1 on line n of the reverse image storage region, so that reverse image conversion processing of whole data is completed Explanation will be made to steps (e) and (i) in the control process explained above, specifically to a method of generating adjusted data of diameter of dot and a method of generating adjusted data of center distance of dots.

Firstly, the method of generating adjusted data of diameter of dot will be explained. The reverse image data comprises binary image data, where black data printed portion) is expressed by "1" and white data (not printed portion) is expressed by "0". The reverse image data is read out and changed according to the type of the object of recording. For example, although the black data "1" for output on the heatsensitive stencil sheet is not changed, the black data for output on the printing paper is changed into "2". The liquid ejecting means is controlled according to the changed data. Namely, "0" shows no output in dot-shape, "1" shows output in dot-shape of small diameter, "2" shows output in dot-shape of large diameter. The diameter of the dot formed from the liquid can be thus controlled.

Now, in a method where quantity of the liquid ejected at one time from the ejecting head is controlled, quantity of the liquid ejected under data "2" is set to be larger than that of under data "1", so that the diameter of the dot formed on the heatsensitive stencil sheet or the printing paper can be controlled. Further, in a method where the number of liquid-ejecting from the ejecting head is controlled, data "1" corresponds to once liquid-ejecting from the ejecting head, data "2" corresponds to twice liquid-ejecting from the ejecting head, so that the diameter of the dot formed on the heatsensitive stencil sheet or the printing paper can be controlled.

The method of generating adjusted data of center distance of dots will be explained. Next operation is effected concerning the reverse image data and the adjusted data of center distance of dots. Resolution possibly attained by nozzle ejecting is enhanced double in both main scanning direction and sub scanning direction. In processing dot-diameter adjusted reverse image data for the heatsensitive stencil sheet, white data "0" is interpolated between dots situated adjacent to each other in both main scanning direction and sub scanning direction. On the other hand, in processing the dot-diameter adjusted data for the printing paper, if two dots situated adjacent to each other in both main scanning direction and sub scanning direction are black data "1" or "2", black data "1" or "2" is interpolated between the dots. In the case where the one or both of the adjacent dots is white data "0", white data "0" is interpolated between the dots. Center distance adjusted data can be obtained by generating such interpolated data. The center distance of the adjacent dots can be controlled by controlling each part of the driven parts of the apparatus by using the data.

According to the present invention, it is not necessary for a heatsensitive stencil sheet to be contacted with anything such like an original or a thermal head in perforation. Perforation can be conducted only by radiating a visible light or an infrared light onto a heatsensitive stencil sheet, so that creasing in a stencil sheet and failure in conveyance of a stencil sheet does not occur.

Further, stencil printing can be conducted when a large number of sheet printing is required, and direct printing on printing paper can be conducted when a small number of sheet printing is required. Hence, it is sufficient for conducting such dual printing that printing papers and heatsensitive stencil sheets are installed in this printing apparatus in the same way as a conventional rotary stencil printing apparatus. Effective printing can be conducted at a low running cost by a small printing apparatus of this invention.

Further, clear printed matter of intense density can be obtained either by stencil printing or direct printing, since the size of the dot recorded on a heatsensitive stencil sheet and a printing paper is arranged by controlling the ejecting means in perforating the heatsensitive stencil sheet and recording the printing paper.

Further, the present invention can be applied to color printing, since multiple printing and process color printing can be conducted by directly printing again on a printing paper processed in stencil printing.

What is claimed is:

1. A printing apparatus comprising:

an ink-permeable printing drum in a cylindrical shape, said printing drum rotatably driven around a central axis thereof and adapted to receive a heatsensitive stencil sheet around an outer circumferential surface of said printing drum, liquid ejecting means for forming an image from photothermal conversion material on said heatsensitive stencil sheet by ejecting a liquid containing said photothermal conversion material to said heatsensitive stencil sheet and for forming an image on a printing paper by ejecting a liquid containing a material selected from the group including a colorant and said photothermal conversion material, light radiating means for perforating said heatsensitive stencil sheet by radiating light to said heatsensitive stencil sheet with said photothermal conversion material transferred thereon, a pressing mechanism for pressing said printing paper against said printing drum, said printing paper being supplied in synchronization with rotation of said printing drum, and for transferring an ink supplied to an inner spherical surface of said printing drum to said printing paper through said perforated heatsensitive stencil sheet, and control means for controlling diameters $R_1$,$R_2$ and distances $D_1$,$D_2$ so that the formula $D_1>R_1,R_2\geqq D_2$ is satisfied, where said diameter $R_1$ is a diameter of a dot of said liquid transferred to said heatsensitive stencil sheet, said diameter $R_2$ is a diameter of a dot of said liquid transferred to said printing paper, said distance $D_1$ is a center distance between two said dots adjacent to each other on said heatsensitive stencil sheet, and said distance $D_2$ is a center distance between two said dots adjacent to each other on said printing paper.

2. A printing apparatus as defined in claim 1, wherein said control means controls said diameters $R_1$,$R_2$ so that the formula $R_2\geqq R_1$ is satisfied.

3. A recording apparatus as defined in claim 1, further comprising:

original image input means, and reverse image generating means for reversing original image data input from said original image input means into reverse image data, whereby a reverse image is recorded on said heatsensitive stencil sheet according to said reverse image data.

4. A recording apparatus as defined in claim 1, wherein said solvent supplying means includes a sole ejecting head disposed selectively at either of a position for ejecting said liquid to said heatsensitive stencil sheet or a position for ejecting said liquid to said printing paper, thereby ejecting said liquid selectively to said heatsensitive stencil sheet or said printing paper.

5. A recording apparatus as defined in claim 1, wherein said solvent supplying means includes plurality of ejecting heads for respectively ejecting plurality of said liquid containing said colorants in different tones so that multicolor printing can be performed.

6. A recording apparatus as defined in claim 1, wherein said heatsensitive stencil sheet includes thermoplastic resin film and liquid absorbent layer laminated on said thermoplastic resin film for absorbing said liquid ejected from said liquid ejecting means.

7. A printing method for use in a printing apparatus comprising:

an ink-permeable printing drum in a cylindrical shape, said printing drum rotatably driven around a central axis thereof and adapted to receive a heatsensitive stencil sheet around an outer circumferential surface of said printing drum, liquid ejecting means for forming an image from photothermal conversion material on said heatsensitive stencil sheet by ejecting a liquid containing said photothermal conversion material to said heatsensitive stencil sheet and for forming an image on a printing paper by ejecting a liquid containing a material selected from the group including a colorant and said photothermal conversion material, light radiating means for perforating said heatsensitive stencil sheet by radiating light to said heatsensitive stencil sheet with said photothermal conversion material transferred thereon, a pressing mechanism for pressing said printing paper against said printing drum, said printing paper being supplied in synchronization with rotation of said printing drum, and for transferring an ink supplied to an inner spherical surface of said printing drum to said printing paper through said perforated heatsensitive stencil sheet, wherein said method comprises controlling diameters $R_1$,$R_2$ and distances $D_1$,$D_2$ so that the formula $D_1>R_1$, $R_2 \geqq D_2$ is satisfied, where said diameter $R_1$ is a diameter of a dot of said liquid transferred to said heatsensitive stencil sheet, said diameter $R_2$ is a diameter of a dot of said liquid transferred to printing paper, said distance $D_1$ is a center distance between two said dots adjacent to each other on said heatsensitive stencil sheet, and said distance $D_2$ is a center distance between two said dots adjacent to each other on said printing paper.

8. A printing method as defined in claim 7, which comprises controlling said diameters $R_1$,$R_2$ so that the formula $R_2 \geqq R_1$ is satisfied.

9. A printing method as defined in claim 7, wherein said image recorded on said heatsensitive stencil sheet is a reverse image and said image recorded on said printing sheet is a non-reverse image.

10. A printing method as defined in claim 7, wherein said liquid ejecting means includes a sole ejecting head disposed selectively at either of a position for ejecting said liquid to said heatsensitive stencil sheet or a position for ejecting said liquid to said printing paper, thereby ejecting said liquid selectively to said heatsensitive stencil sheet or said printing paper.

11. A printing method as defined in claim 7, wherein said liquid ejecting means includes plurality of ejecting heads for ejecting respectively plurality of said liquid containing said colorants in different tones so that multicolor printing can be performed.

12. A printing method as defined in claim 7, wherein said heatsensitive stencil sheet includes thermoplastic resin film and liquid absorbent layer laminated on said thermoplastic resin film, said method further comprises ejecting said liquid on said absorbent layer of said heatsensitive stencil sheet by said liquid ejecting means, and causing said photothermal conversion material contained in said liquid to heat up by radiating light to said heatsensitive stencil sheet by means of said light radiating means, thereby perforating said thermoplastic resin film.

* * * * *